US006966841B1

(12) United States Patent
Sherman

(10) Patent No.: US 6,966,841 B1
(45) Date of Patent: Nov. 22, 2005

(54) PLAYGROUND PLAY SURFACE

(76) Inventor: Elaine Sherman, 318 N. Lincoln Hwy., North Aurora, IL (US) 60542

( * ) Notice: Subject to any disclaimer, the term of this patent is extended or adjusted under 35 U.S.C. 154(b) by 0 days.

(21) Appl. No.: 10/900,796

(22) Filed: Jul. 28, 2004

(51) Int. Cl.[7] ..... A63C 19/10
(52) U.S. Cl. ..... 472/89; 404/32; 472/92
(58) Field of Search ..... 472/88, 89, 92, 472/94; 428/17, 92, 95, 87, 77; 404/32, 33

(56) References Cited

U.S. PATENT DOCUMENTS 4,948,116 A * 8/1990 Vaux ..... 472/92
5,085,424 A * 2/1992 Wood, Jr. ..... 472/92
5,183,438 A * 2/1993 Blom ..... 472/92
5,525,416 A * 6/1996 Katz et al. ..... 428/193
5,823,711 A * 10/1998 Herd et al. ..... 405/36
6,071,039 A * 6/2000 Ogura et al. ..... 404/32
6,221,445 B1 * 4/2001 Jones ..... 428/17
6,287,049 B1 * 9/2001 Keinholz ..... 405/46
6,796,096 B1 * 9/2004 Heath ..... 52/403.1

* cited by examiner

*Primary Examiner*—Kien Nguyen
(74) *Attorney, Agent, or Firm*—Alan B. Samlan; Basil E. Demeur; David J. Hurley

(57) ABSTRACT

A unique playground play surface that is safe and suitable for use by physically challenged individuals and those that require the assistance of wheelchairs or other devices. The playground play surface consists of a base layer, a covering layer, a bag layer, a loose particles layer, and a top layer. The bag layer consists of a plurality of bags each filled with loose or shredded rubber. The bags are aligned side by side forming a single layer of rows and columns. A retaining border defines the playground play surface and contains the layers.

14 Claims, 4 Drawing Sheets

FIG. 7

Summary
Detroit Testing Laboratory

| | | | Control # Fails over | System A bag 1.2 | System B bag 1.4 | System C stab - 1.0 | System D stab - 1.2 |
|---|---|---|---|---|---|---|---|
| ASTM F 1951-99 | Wheelchair | straight | 13.068 | 11.819 | 8.517 | 11.579 | 8.158 |
| ASTM F 1951-99 | Wheelchair | turn | 13.692 | 8.008 | 7.652 | 7.07 | 7.157 |
| ASTM F 1292-99 | Head Impact | 132ft@ -6C | 1000 HIC | 591.67 | 785.54 | 635.259 | 705.5 |
| ASTM F 1292-99 | Head Impact | 132ft@ -6C | 200 g | 92.25 | 101.75 | 87.37 | 93.25 |
| ASTM F 1292-99 | Head Impact | 132ft@ 23C | 1000 | 521.42 | 622.78 | 523.03 | 664.36 |
| ASTM F 1292-99 | Head Impact | 132ft@ 23C | 200 | 78.87 | 83.87 | 80.25 | 97.87 |
| ASTM F 1292-99 | Head Impact | 132ft@ 49C | 1000 | 491.5 | 564.25 | 405 | 590.03 |
| ASTM F 1292-99 | Head Impact | 132ft@ 49C | 200 | 90.25 | 84.75 | 70.37 | 92.5 |

PLAYGROUND PLAY SURFACE

I. FIELD OF THE INVENTION

The present invention relates to playground play surfaces and more particularly to a safe playground play surface that is suitable for use by physically challenged individuals requiring the assistance of a wheelchair. This invention is also directed to using shredded rubber tires for a portion of the play surface thus assisting in recycling old and worn out tires.

II. DESCRIPTION OF THE PRIOR ART

Over the years, playgrounds have evolved into several different forms. An example of an early playground consisted of a natural grass surface. Although natural grass provided an easy means to create the playground, this type of surface provided inherent problems. The grass required constant maintenance such as mowing and weed control; the underlying soil was subject to erosion and possibly poor drainage; and the soil was susceptible to becoming compacted, thereby, inhibiting the growth of the grass while reducing the capacity of the grass to absorb impact from playing.

In an attempt to solve the problems presented by natural grass surfaces, playgrounds began to be constructed of materials such as sand, gravel, wood mulch, wood chips, elastic chips, and/or rubber. Examples of such playgrounds are found in U.S. Pat. No. 6,287,049 to Keinholz entitled "Layered Foundation For Play Surface"; U.S. Pat. No. 6,071,039 to Ogura, et al., entitled "Structure of Surface Portions of Grounds"; and U.S. Pat. No. 5,525,416 to Katz, et al., entitled "Play Area Surface Treatment." While these play surfaces are improvements over the natural grass surfaces, they do not accommodate and/or are not usable by physically challenged or handicap individuals requiring the assistance of aids such as wheelchairs. Thus, there is a need and there has never been disclosed Applicant's unique playground play surface that is suitable for use by physically challenged or handicap individuals requiring the assistance of external aids.

III. OBJECTS OF THE INVENTION

It is the primary object of the present invention to provide a playground play surface that is suitable for use by physically challenged or handicap individuals. A related object of the present invention is to provide a playground play surface that accommodates use of such individuals requiring assistance from external aids such as wheelchairs.

Another object of the present invention is to provide a playground play surface that provides a resilient surface for supporting the external aids of the disabled uses and is solid enough to sustain the disabled users walking, ride, or manipulating across the surface of the playground without tripping, falling, or otherwise endangering themselves.

Another object of the invention is to provide a playground play surface that is capable of conforming to specifications of the Americans With Disabilities Act.

Still another object of the invention is to provide a playground play surface that is safe and easy to use.

Other objects of the present invention will become more apparent to persons having ordinary skill in the art to which the present invention pertains from the following description taken in conjunction with the accompanying drawings.

IV. SUMMARY OF THE INVENTION

The present invention is a unique playground play surface that is safe and suitable for use by physically challenged individuals and those that require the assistance of wheelchairs or other devices. The playground play surface consists of a base layer, a covering layer, a bag layer, a loose particles layer, and a top layer. The bag layer consists of a plurality of bags each filled with loose or shredded rubber. The bags are aligned side by side forming a single layer of rows and columns. A retaining border defines the playground play surface and contains the layers.

V. BRIEF DESCRIPTION OF THE DRAWINGS

The Description of the Preferred Embodiment will be better understood with reference to the following figures:

FIG. 7 is a chart depicting the results of Applicant's playground play surface.

VI. DETAILED DESCRIPTION OF THE PREFERRED EMBODIMENT

Figure 1:
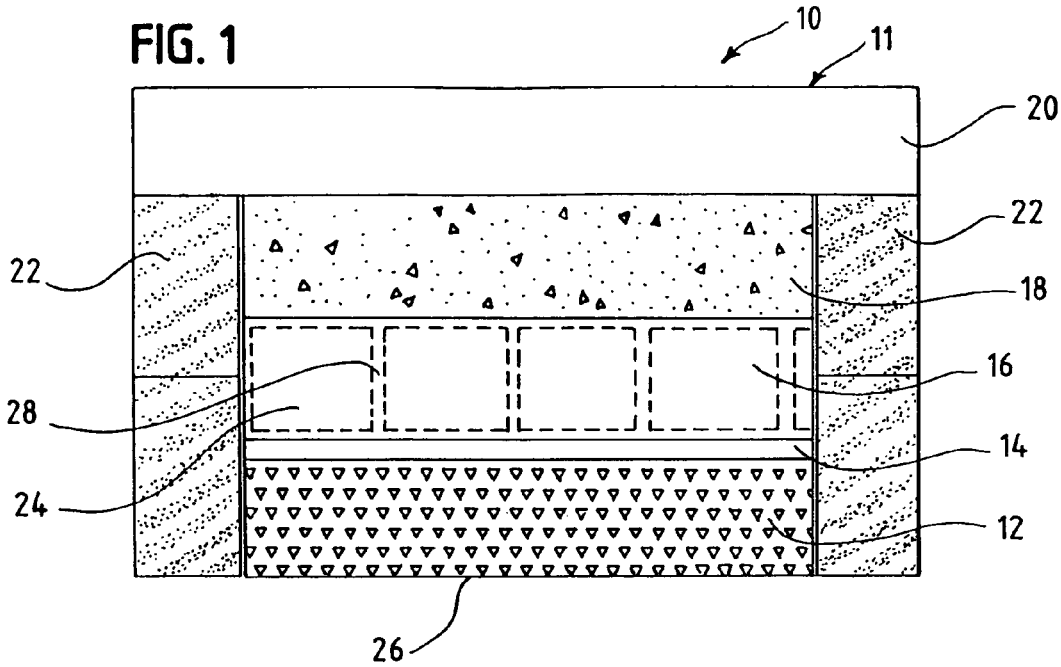
FIG. 1 is a side cross-sectional view of Applicant's playground play surface.

Turning first to FIG. 1, there is illustrated a playground play surface 10 that embodies the present invention. The playground play surface 10 consists of layers 11, specifically, a base layer 12, a covering layer 14, a bag layer 16, a loose particles layer 18, and a top layer 20. With the exception of the top layer 20, the layers 11 are all contained with a retaining border 22 extending around the entire circumference of the playground play surface 10. In the preferred embodiment, the sequence of the layers 11 to form the playground play surface 10 is as previously identified: first, the base layer 12; second, the covering layer 14; third, the bag layer 16; fourth, the loose particles layer 18; and fifth, the top layer 20. Each layer 11 directly abuts against each of its adjoining layers. The overall surface area of the playground play surface 10 may be as large or as small as the designated playground area allows or, alternatively, is designed to accommodate. Also, the playground play surface 10 may be installed either completely above, completely below, or partially above and partially below the ground level.

The base layer 12 is the first layer of the playground play surface 10. The base layer 12 consists of course drainage material such as a gravel or stone material. In the preferred embodiment, the gravel or stone is a washed stone, size 7. Alternatively, the gravel or stone may be any size suitable for providing a base layer with sufficient strength and drainage. In the event the playground play surface 10 is installed above the surface of the ground level, the preferred minimum depth of the base layer 12 is substantially four inches (4"). In the event the playground play surface 10 is partially or completely subgrade, the preferred minimum depth of the base layer 12 is four inches (4"). If, however, the playground play surface 10 is to be installed in a location where soil drainage is not a problem, the base layer 12 may not be required.

The covering layer 14 is the second layer of the playground play surface 10. In the preferred embodiment, the covering layer 14 is a geo textile fabric. The geo textile fabric is a water permeable mat made out of spun polypropylene used to suppress weeds or to control erosion while allowing the free exchange of water and air. The purpose of the geo textile fabric is, therefore, twofold: (1) to provide a good separation between the base layer 12 and the bag layer 16 and, if subgrade, alleviate the gravel or stone from being pushed into the ground soil or mud; and (2) as the geo textile fabric is uniquely suited for drainage, to facilitate the drainage of water that exists or arises within the playground play surface 10 and between the base layer 12 and the bag layer 16.

Figure 2:
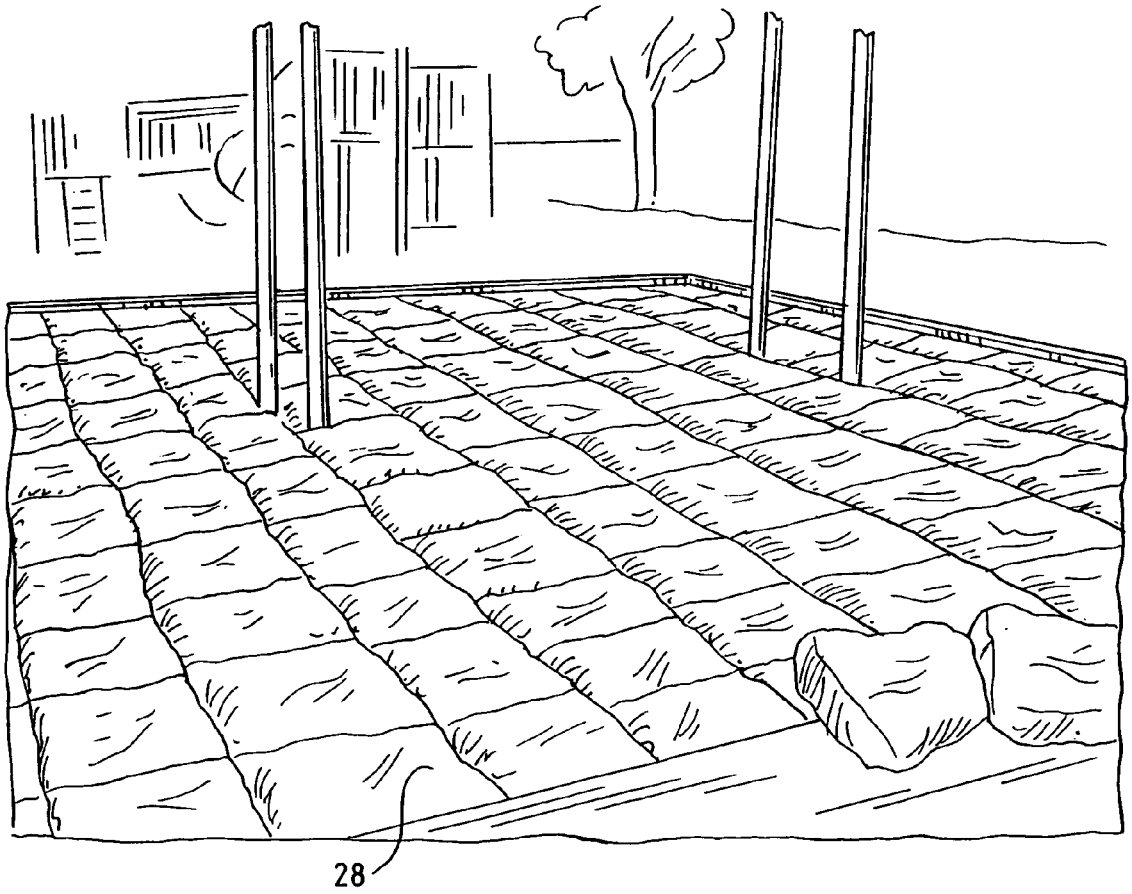
FIG. 2 is a perspective view of the bag layer of Applicant's playground play surface.

The bag layer 16 is the third layer of the playground play surface 10. The bag layer 16 consists of a plurality of bags 24, each aligned side by side and forming a single layer of rows and columns as illustrated in FIG. 2. Although the bags 24 are each adjacent to one another, the bags 24 produce gaps 28 throughout. In the preferred embodiment, the bags 24 are thirty inches (30") in length by eighteen inches (18") in width by three inches (3") in height in size and provides a volume of forty-five pounds (45 lbs.) per bag. The bags 24 are made of a durable polypropylene (geo-textile fabric) and provide gussets for additional strength. The total number of bags 24 in the bag layer 16 is directly proportionate to the overall surface area of the playground play surface 10. Each bag 24 is filled with multiple fragments of resilient material. Preferably, the multiple fragments of resilient material is loose or shredded rubber. The size of the loose or shredded rubber is approximately one-half inch (½") in length by one-half inch (½") in width by one-half inch (½") in height. The bags 24 are the specific size and volume fill by density to assure uniformity of the surface of the bag layer 16. Preferably, the volume of multiple fragments of resilient material is substantially twelve pounds per square foot (12 lbs./sq. foot).

Applicant utilizes a procedure to create the loose or shredded rubber. Preferably, the loose or shredded rubber comes from a combination of passenger, light truck, truck and agricultural recycled old and worn out or scrap tires. First, the tires are processed through a Shredtech 250 horsepower shredder to shred the tires into two inch (2") rubber chips. During this process, the material is washed to clean and remove foreign materials. The material is then conveyed under a rare earth crossbelt magnet to remove any large pieces of wire from the tire tread. Secondly, the tires are processed through an Eldan 162HR Rasper to shred the chips and reduce them to a three-quarter inch (¾") chip. The material passes through a water spray mist for further cleaning. During this cleaning process, the material is washed and rinsed with enzymes to reduce lead and prohibit the accumulation or growth of bacteria. The material is then processed through an Eriez rare earth drum magnet to remove any wire that may still be in the product. Lastly, the material passes through another Eriez rare earth drum magnet to insure that all of the tire wire has been removed. The material is then sent through a Rotex triple deck screen where the remaining chips that are larger or smaller than substantially one-half of an inch (½") are removed and used elsewhere. The material has now been sized, is 99% wire and contaminate free, cleaned and ready for installation. While there are numerous machines and processes for shredding tires into loose or shredded rubber, the equipment and procedure identified has proven to be very reliable in achieving the quality and standards required in the industry.

The loose particles layer 18 is the fourth layer of the playground play surface 10. The loose particles layer 18 consists of the same multiple fragments of resilient material (i.e., loose or shredded rubber) used in the bags 24. In the preferred embodiment, the loose particles layer 18 is substantially one inch (1") thick.

The top layer 20 is the fifth and final layer of the playground play surface 10. The top layer 20 consists, depending upon the surface area of the playground play surface 10, of either a single mats or of a number of mats, each aligned side by side and forming a single top layer 20. The mats are preferably made of an extruded P.V.C. In the preferred embodiment, the mats are twenty-five feet (25') in length, by six feet (6') in width, by three-eights of an inch (⅜") to one-half of an inch (½") in height. Alternatively, the mats may be longer to accommodate the length of the playground.

Figure 3:
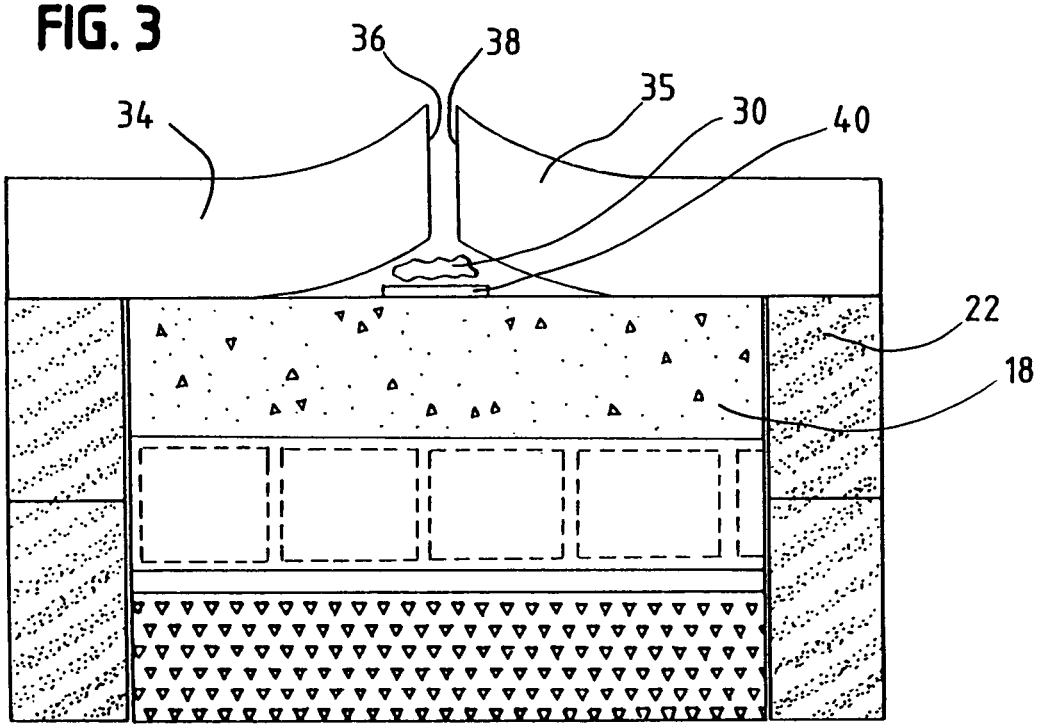
FIG. 3 is a side cross-sectional view of multiple mats of the top layer 20 in the process of being attached at the seams.
Figure 4:
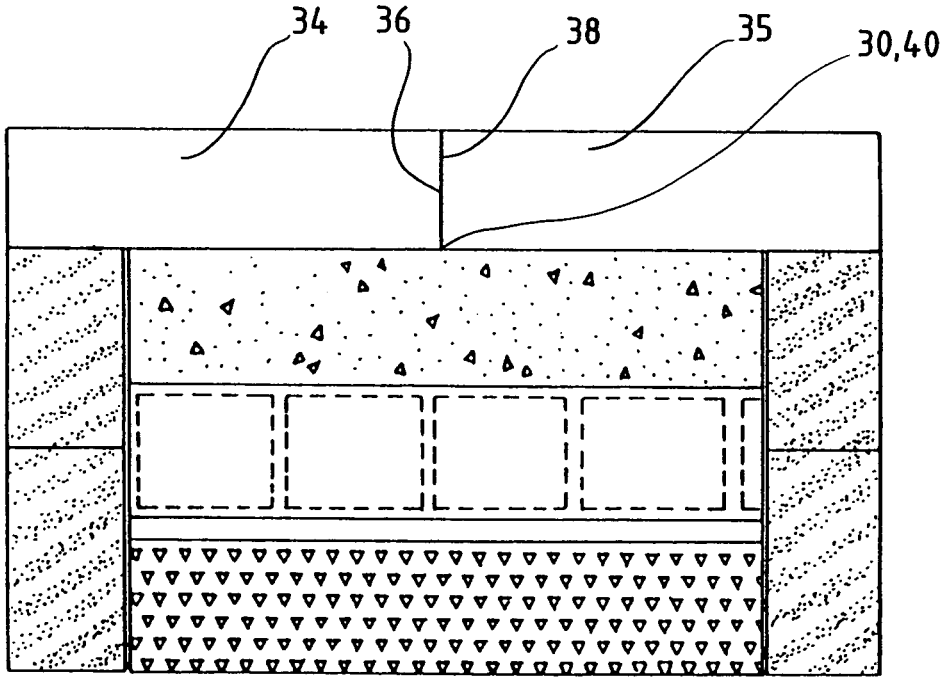
FIG. 4 is a side cross-sectional view of the multiple mats as attached at their seams.
Figure 5:
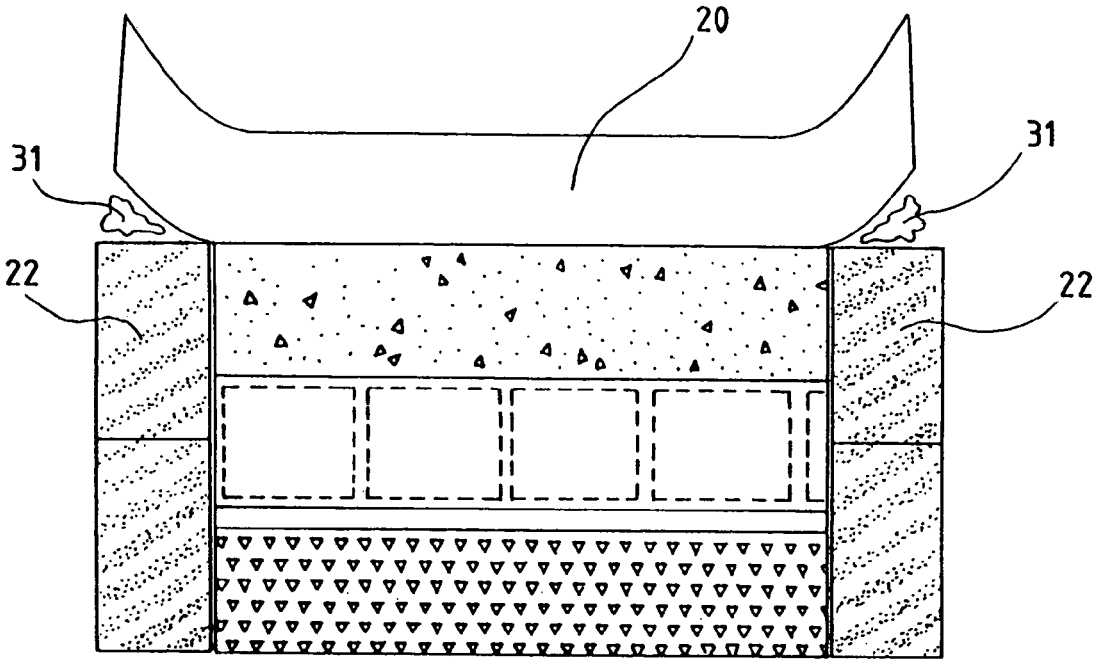
FIG. 5 is a side cross-sectional view of the exterior edges of the mats of the top layer 20 in the process of being attached to the retaining border.

During installation, in the event the top layer 20 requires multiple mats, each mat is attached to each adjacent mat by glue as illustrated in FIG. 3. Mats 34 and 35 each have an edge 36 and 38, respectively. An understrip 40 is equally spaced underneath mats 34 and 35 and edges 36 and 38. In the preferred embodiment, the understrip 40 is a strip made of P.V.C. and is substantially three inches (3") in width. A glue 30 is placed on the side of the understrip 40 facing the mats 34 and 35, on the side of the mats 34 and 35 facing the understrip 40, or both. In the preferred embodiment, the glue 30 is a rubber toughant cyanoacrylic adhesive and a urethane glue. Upon affixing the glue 30 to the understrip 40, the mats 34 and 35 are folded over onto the glue 30 and the understrip 40 such that the edge 36 of mat 34 and the edge 38 of mat 35 engage each other for forming a tight seal between the mats as illustrated in FIG. 4. Also, the seam between the adjacent mats 34 and 35 can be sprayed with an accelerator to assist in setting the glue 30. A separate glue 31, preferably a rubber toughant cyanoacrylic adhesive or a urethane glue, without the understrip 40, is used for the attachment of the exterior end of the mat to the entire perimeter of the retaining border 22 as illustrated in FIG. 5, or to the base of the playground equipment. The urethane glue is waterproof and less expensive and easier to use than other epoxies.

Figure 6:
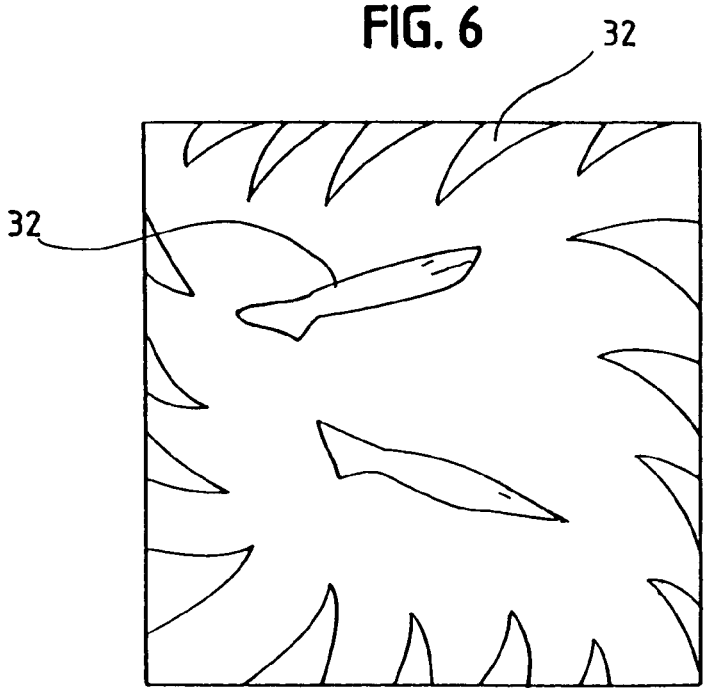
FIG. 6 is a top plan view of the top layer of the playground play surface with a multi colored inlay design thereon.

The top layer 20 of the playground play surface 10 may, as illustrated in FIG. 6, may be displayed with multi colored inlay designs 32. In the non-limiting example provided, the multi colored inlay design 32 consists of fish swimming in an ocean of waves. Alternatively, any multi colored inlay design 32 can be use which is limited only by the imagination of the user.

The retaining border 22 defines the exterior perimeter of the playground play surface 10 and retains the layers 11 within a defined area. Preferably, the retaining border 22 is made of recycled timber. The reason that recycled timber is used is because of cost and minimal thermal expansion. Additionally, as the timber is recycled, this reduces the drain and further exhaustion of our natural resources. Alternatively, the retaining border 22 may be made of recycled plastic, but this tends to expand and contract with the heat to a much greater amount than recycled timber. A concrete curb or concrete walkway may also be used as the retaining border 22 for the playground play surface 10.

To create the playground play surface 10, the retaining border 22 is installed to establish the exterior perimeter of the playground play surface 10 and define a surface area 26 of the playground. Within the surface area 26, the base layer 12 is the first layer installed. The gravel or stone material is filled over the entire surface area 26 inside the retaining border 22. The gravel or stone material is raked to evenly disburse the gravel or stone material, and then compacted into a leveled, uniform surface. Any human or machine powered means is acceptable to compact the base layer 12 provided that the base layer 12 is leveled into a uniform surface. Next, the covering layer 14 of the geo textile fabric is installed over the entire base layer 12 inside the retaining border 22. Next, the bag layer 16 of bags 24 are installed over the entire covering layer 14 inside the retaining border 22. The bags 24 are then compacted into a leveled, uniform base and surface. The size and density of the bags 24 assures uniformity of this surface prior to actual physical compaction. Any human or machine powered means, or any combination thereof, is acceptable to compact the bag layer 16 provided that the bag layer 16 is leveled into a uniform surface. Applicant has found that setting plywood boards on top of the bags 24 and then using a vibrating compactor on top of the bags 24 facilitates the compacting process and sets the bag layer 16 into a leveled, uniform surface. This compaction also firms the rubber sub base within the bags 24. Next, the loose particles layer 18 of loose or shredded rubber is filled over the entire bag layer 16 inside the retaining border 22 and then evenly distributed to fill in the gaps 28 between each adjoining bag 24 and form a leveled, uniform loose particles layer 18 surface. Next, the top layer 20 is installed over the entire loose particles layer 18 and the retaining border 22. The playground play surface 10 is now finished.

As a result, the layers 11 provide a playground play surface 10 which creates a safe playground play surface that is suitable for use by physically challenged individuals such that the rigid and resilient surface of the playground allows wheeled apparatus to easily move over the top layer. The playground play surface also enables the highest play element impact attenuation for children. Applicant's testing of the playground play surface 10 is revealed in the chart provided in FIG. 7. The standards for wheelchairs and head impact of the playground play surface are provided in relation to the results of Applicant's various embodiments. For example, System A is for a bag 24 filled with 1.2 pounds per square foot of material. System B is for a bag 24 filled with 1.4 pounds per square foot of material. System C is the alternate embodiment of the playground play surface using the stabilizer layer 42 with 1.0 pounds per square foot of material. System D is the alternate embodiment of the playground play surface using 1.2 pounds per square foot of loose material. If the results of Applicant's various embodiments or systems exceed the standard control number, the playground play surface fails. The results, however, reveal that all of Applicant's various embodiments exceed the required standards and, in some instances, provide dramatic increases in wheelchair and head impact safety for children.

Thus, there has been provided a unique playground play surface as described herein. While the invention has been described in conjunction with a specific embodiment, it is evident that many alternatives, modifications and variations will be apparent to those skilled in the art in light of the foregoing description. Accordingly, it in intended to embrace all such alternatives, modifications and variations as fall within the spirit and scope of the appended claims.

What is claimed is:

1. A play surface for installation on the ground, comprising:

a first layer of course drainage material;

a second layer of water permeable material is placed on the first layer;

a third layer of closed bags having flexible walls, the bags filled with multiple fragments of resilient material placed on the second layer, the bags placed adjacent to each other to restrict lateral movement;

a fourth layer of the multiple fragments of resilient material placed on the third layer; and a top mat layer of resilient material placed on the fourth layer;

whereby, the first layer, the second layer, the third layer, the fourth layer, and the top mat layer coact for providing a rigid and resilient play surface that allows wheeled apparatus to easily move over the top mat layer.

2. The play surface of claim 1 and further comprising a retaining border, the retaining border defining the boundary of the play surface and containing the first layer, the second layer, the third layer, and the fourth layer.

3. The play surface of claim 2 wherein the top mat layer is attached to the retaining border by glue.

4. The play surface of claim 1 wherein the first layer of course drainage material is placed on top of the ground.

5. The play surface of claim 1 wherein the first layer of course drainage material is placed in an excavated hole in the ground.

6. The play surface of claim 1 wherein the course drainage material comprises gravel or stone.

7. The play surface of claim 1 wherein the water permeable material is a geo textile fabric material.

8. The play surface of claim 1 wherein each of the bags is filled with substantially thirty pounds of multiple fragment of resilient material.

9. The play surface of claim 1 wherein the multiple fragments of resilient material is shredded rubber.

10. The play surface of claim 1 wherein the top mat layer of resilient material is a rubberized compound.

11. The play surface of claim 1 wherein the top mat layer of resilient material displays multi colored inlay designs.

12. A method for installing a play surface, comprising the steps of:

(a) installing a first layer of course drainage material;

(b) installing a second layer of water permeable material on the first layer;

(c) installing a third layer of closed bags having flexible walls, the bats filled with multiple fragments of resilient material placed on the second layer, the bags placed adjacent to each other to restrict lateral movement;

(d) installing a fourth layer of the multiple fragments of resilient material on the third layer; and (e) installing a top mat layer of resilient material placed on the fourth layer;

whereby, the first layer, the second layer, the third layer, the fourth layer, and the top mat layer coact for providing a rigid and resilient play surface that allows wheeled apparatus to easily move over the top mat layer.

13. The method of claim 12 and further comprising the step of installing a retaining border defining the boundary of the play surface and containing the first layer, the second layer, the third layer, and the fourth layer.

14. The method of claim 12 and further comprising the step of compacting each layer into a leveled, uniform surface.

* * * * *

UNITED STATES PATENT AND TRADEMARK OFFICE

CERTIFICATE OF CORRECTION

PATENT NO. : 6,966,841 B1
DATED : November 22, 2005
INVENTOR(S) : Sherman, Elaine It is certified that error appears in the above-identified patent and that said Letters Patent is hereby corrected as shown below:

Column 6,
Line 41, delete “bats” and insert -- bags --.

Signed and Sealed this

Twenty-fourth Day of January, 2006

JON W. DUDAS
*Director of the United States Patent and Trademark Office*